US011285740B2

(12) United States Patent
Sanz Ananos et al.

(10) Patent No.: US 11,285,740 B2
(45) Date of Patent: Mar. 29, 2022

(54) CUTTER MODULE POSITIONING FOR FULL-BLEED PRINTING

(71) Applicant: HEWLETT-PACKARD DEVELOPMENT COMPANY, L.P., Spring, TX (US)

(72) Inventors: Isabel Sanz Ananos, Sant Cugat del Valles (ES); Martin Urrutia Nebreda, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,898

(22) PCT Filed: Apr. 30, 2018

(86) PCT No.: PCT/US2018/030138
§ 371 (c)(1),
(2) Date: Oct. 1, 2019

(87) PCT Pub. No.: WO2019/212470
PCT Pub. Date: Nov. 7, 2019

(65) Prior Publication Data

US 2021/0331494 A1 Oct. 28, 2021

(51) Int. Cl.
*B41J 11/66* (2006.01)
*B41J 11/68* (2006.01)
*B41J 11/70* (2006.01)

(52) U.S. Cl.
CPC ..... *B41J 11/663* (2013.01); *B41J 11/68* (2013.01); *B41J 11/706* (2013.01)

(58) Field of Classification Search
CPC ..... B41J 11/663; B41J 11/68; B41J 11/706
See application file for complete search history.

(56) References Cited

U.S. PATENT DOCUMENTS

| | | | | |
|---|---|---|---|---|
| 4,604,934 | A | 8/1986 | Elliott et al. | |
| 4,649,782 | A | 3/1987 | Cavangna | |
| 6,109,745 | A * | 8/2000 | Wen | B41J 11/0065 347/101 |
| 6,394,669 | B1 | 5/2002 | Janosky et al. | |
| 6,469,806 | B1 | 10/2002 | Richenderfer et al. | |
| 7,815,382 | B2 | 10/2010 | Monclus et al. | |
| 8,312,798 | B2 | 11/2012 | Kwarta et al. | |
| 9,278,556 | B2 | 3/2016 | Yoshizawa | |
| 9,487,035 | B2 | 11/2016 | Wakayama | |
| 2011/0283855 | A1 * | 11/2011 | Kwarta | B26D 7/18 83/425.4 |
| 2014/0112695 | A1 | 4/2014 | Van Dijk et al. | |
| 2017/0120634 | A1 | 5/2017 | Navarro et al. | |

* cited by examiner

*Primary Examiner* — Henok D Legesse
(74) *Attorney, Agent, or Firm* — HP Inc. Patent Department

(57) ABSTRACT

A printer comprises at least one longitudinal cutter module to cut a print medium in a longitudinal direction with respect to a print media advance direction. The printer comprises a controller to position the longitudinal cutter module along a direction perpendicular to the print media advance direction. The controller is to receive a full-bleed print job and in response to receive print job to position the at least one cutter module along the direction perpendicular to the print media advance direction. The longitudinal cutter module is positioned by the controller to longitudinally cut the print medium.

11 Claims, 9 Drawing Sheets

CUTTER MODULE POSITIONING FOR FULL-BLEED PRINTING

BACKGROUND

Printers may deposit a printing substance on print media. Full-bleed printing may comprise depositing a print area of printing substance which extends to at least one edge of a print medium.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Printers may deposit printing substance such as ink, or another printing fluid, on media. The printer may deposit printing substance on media that may be fed through the system from a roll of media. In other situations, the media may be picked from a stack or ream of media for its processing by the printer, or media may be fed into the printer one sheet at a time.

Full-bleed printing involves producing a print job on a medium where the deposited printing substance extends to the edges of the medium. For example, a full-bleed print job may comprise deposited printing substance extending substantially near to the edges of the medium, for example to within a predetermined tolerance of the edges of the medium, such as a predetermined tolerance of around 1 mm, 2 mm, 3 mm, 4 mm, or 5 mm, or a tolerance based on a width of a print area or media, for example a tolerance of around 0.1%, or around 1%, of the width of the print area or of the media. In some examples, full-bleed printing may comprise printing entirely to the edges of the print medium, i.e. without any blank margins. As described herein, a full-bleed print may refer to a print job extending to a particular edge of the medium being printed on. A full-bleed printing method may, for example, be used to produce a poster or other print job where it is desirable not to have blank margins. In some examples, full-bleed printing may be provided for by depositing printing substance over a print area which extends outside the edges of the medium being printed on, to ensure that the print substance is deposited right to the edges of the medium. This may be referred to as overspraying. Where overspraying is used, in some examples, a surface of the printer, for example an absorbent surface such as a foam, may be positioned to receive the printing substance deposited outside of the surface of the print medium.

In examples, a print medium may be advanced through a printer, in a direction of media advance, to have a printing substance deposited on it. The print medium may in some examples have a leading edge at the downstream end of the print medium with respect to the direction of media advance. The print medium may also have a trailing edge, being an upstream edge of the print medium with respect to the direction of media advance. In examples, the print medium may also have lateral edges. The lateral edges may be substantially parallel with the direction of media advance.

Figure 1:
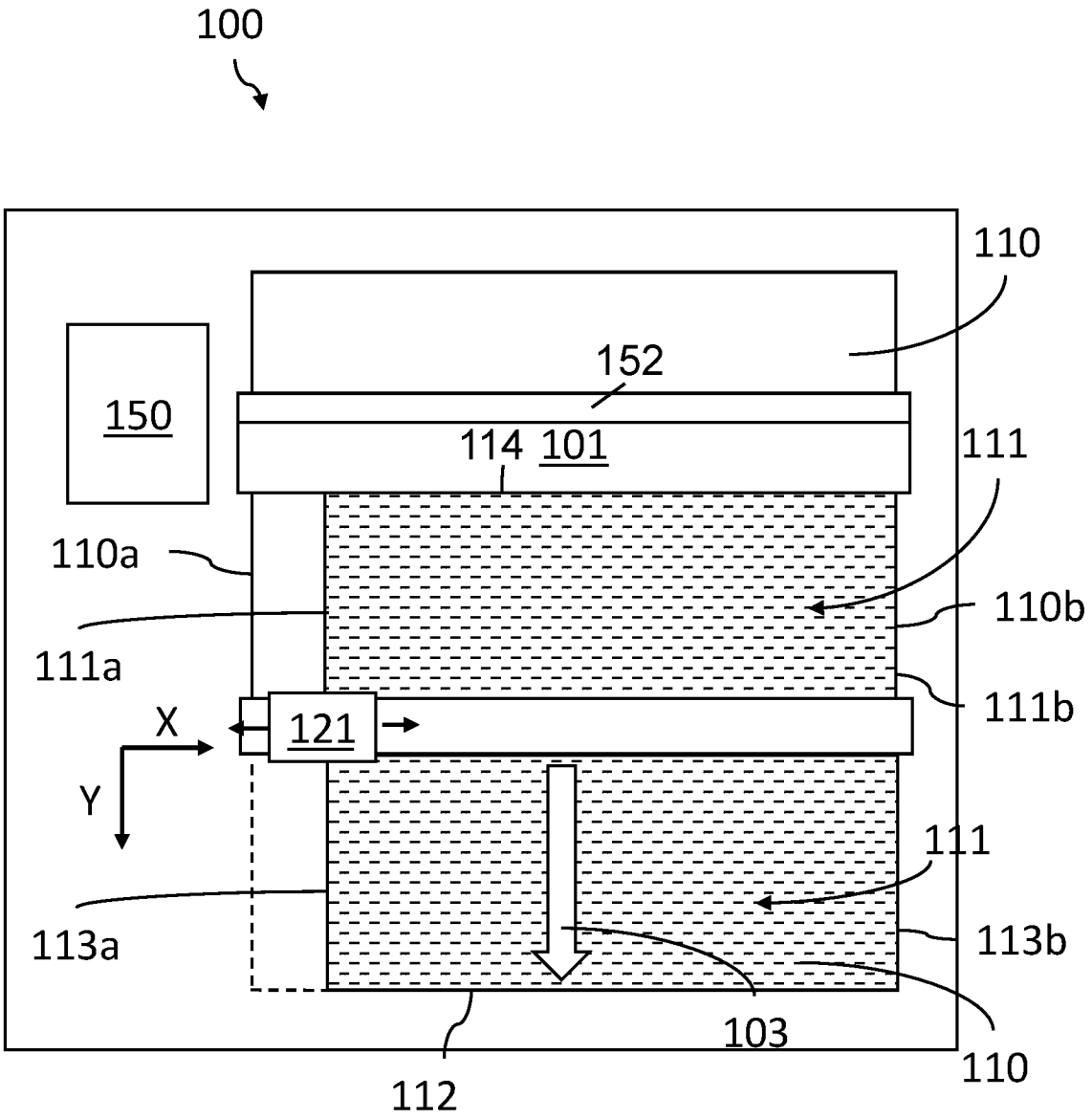
FIG. 1 shows a schematic representation of an example printer.
Figure 2:
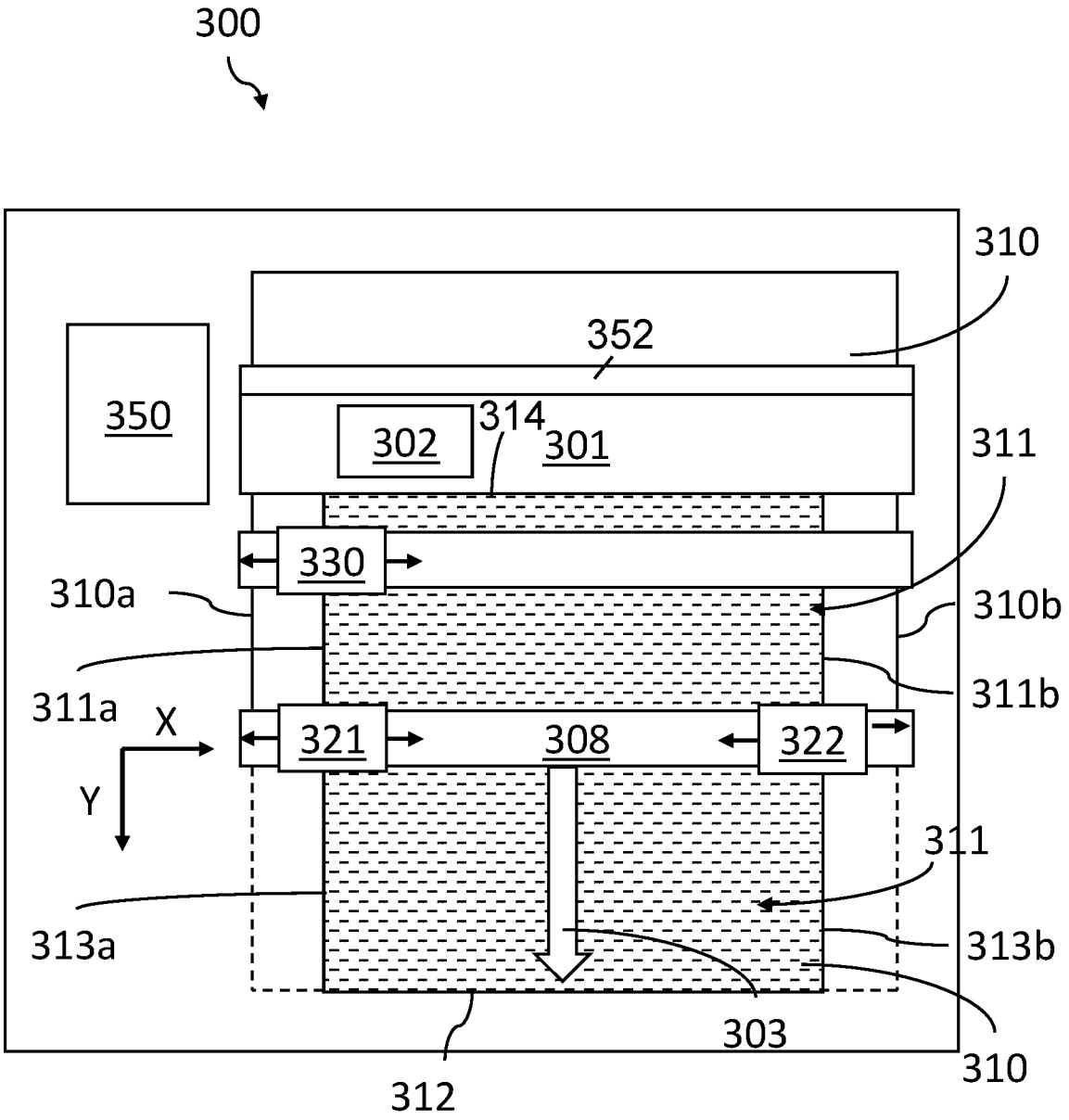
FIG. 2 shows a schematic representation of another example printer.

FIG. 1 shows a schematic representation of a printer 100 for receiving a full-bleed print job and cutting media 110 in response to the received print job. The printer 100 comprises a controller 150 to receive the full-bleed print job. For example, the printer 100 may receive the full-bleed print job as an input, for example from a user. In examples, the controller is to receive the full-bleed print job and in response to the input to position the at least one cutter module along the direction perpendicular to the print media advance direction to longitudinally cut the print medium. The controller 150 may position the longitudinal cutter module 121 to longitudinally cut the media 110 at a position such that a full-bleed output is produced. The printer 100 comprises a printing substance depositer 101, which may for example comprise at least one print head (not shown in FIG. 1) for depositing a printing substance, such as ink, on the print media 110. The media 110 advances through the printer 100 in a media advance direction 103, i.e. along a Y direction, and the printing substance depositer 101 deposits printing substance on the media 110 in a print area 111 on the media 110. The print medium 110 has a first lateral edge 110*a* and a second lateral edge 110*b*. The printer 100 comprises a longitudinal cutter module 121 which is able to be positioned along a direction perpendicular to the direction of media advance 103, i.e. along the X direction. In examples, the longitudinal cutter module 121 is positioned downstream of the printing substance depositer 101, with respect to the media advance direction 103. In response to receiving an input specifying a full-bleed print job, the controller 150 positions the longitudinal cutter module 121 to longitudinally cut the media 110 at a position perpendicular to the direction of media advance 103. This position may be at, or within, a first lateral margin 111*a* of the print area 111. In some examples, the position may be within a predetermined distance outside of the print area 111, for example within a predetermined tolerance, as described above. The controller 150 controls the longitudinal cutter module 121 to cut the media 110 as it advances in the direction 103. As such, a first full-bleed edge 113*a* is produced by the cutting of the media 110 by the longitudinal cutter module 121. The lateral position of the cut for producing a full-bleed lateral edge may be substantially at the lateral edge of the print area 111, or within the print area 111 so that some of the print area 111 is removed from the medium 110 by the cut made. The portion/s of the media 110 removed by the longitudinal cutter/s is shown in FIGS. 1 and 2 by broken lines. The portion cut to produce the full-bleed print edge extends longitudinally from the leading edge 112 to the trailing edge 114 of the print output.

In examples, the printer 100 produces a full-bleed print output having a second full-bleed print edge 113*b*. The second full-bleed print edge 113*b* may, in some examples, be produced by overspraying printing substance at a second lateral edge 110*b* of the media 110. In some examples, the printer 100 may also comprise a lateral cutter (not shown in FIG. 1) for cutting the media 110 in the X direction and producing a full-bleed print at a trailing, upstream, edge 114 of the media 110. The printer 100 may also, in some examples, produce a full-bleed print edge at the leading edge 112 of the print media 110, for example by overspraying at that edge. The printer 100 therefore, in examples, outputs a full-bleed print output in response to the controller 150 receiving a full-bleed print job. In some examples, the received full-bleed print job may specify data indicating the X position of one or more margins 111*a*, 111*b* of the print area 111 and the controller 150 may position the longitudinal cutter module 121 based on the data indicating the position of the one or more of margins 111*a*, 111*b*. In some examples, the input may specify Y co-ordinates of the leading margin 112 and trailing margin 114. In some examples, the input may specify a predetermined width and the X co-ordinates of the margins 111*a*, 111*b* may be determined by the printer 100, for example by the controller 150. For example, by positioning the print area centrally on the print media, or otherwise determining X co-ordinates for positioning the print area on the media. In some examples, the controller 150 may determine, from the print job, the width of the print output and position the longitudinal cutter module 121 accordingly to produce a full-bleed print output of the determined width. For example, the controller 150 may determine the width of the print output from an input specifying the margins 111*a*, 111*b* of the print area 111. The controller 150 may, in some examples, position the longitudinal cutter module 121 to an X position to cut the media 110 to produce a full-bleed print output having the determined width.

In some examples, the controller 150 may position the longitudinal cutter module 121 to produce a full-bleed print edge where the first margin 111*a* is not fully aligned with the print media advance direction 103. The controller 150 may, for example, change the position of the longitudinal cutter module 121 as the media 110 advances, to follow a print margin 111*a* which is not linear, or which is not aligned with the print media advance direction 103. The printer 100 may, therefore, in some examples correct for a skew in the print area 111, for example due to the print media 110 becoming misaligned with the Y direction. For example, misalignment of the media 110 with the media advance direction 103 may occur due to initial misalignment of the media 110 upon loading into the printer 100. In examples, where the printer 100 prints on a roll of media 110, layers, such as outer layers, of the roll of media 110 may become displaced in the axial direction of the roll of media 110. There may therefore be a displacement of the media 110 along the X direction as the roll of media 110 is fed into the printer 100. This displacement may, for example, occur due to handling of the roll of media 110 by a user, and may be referred to as a telescoping error. In examples the displacement may be on the order of a few millimetres, in other examples the displacement may be larger. In examples, the printer 100 may correct for misalignment errors, such as telescoping errors. For example, the printer 100 may comprise a sensor for detecting the lateral position of the media 110 as it is advanced into the printer 100. The printer 100 may, for example, comprise an optical sensor (not shown) for detecting the lateral position of the media, for example for detecting the lateral edges 110*a*, 110*b* of the media 110. The optical sensor may be, in examples, be located on a print head (not shown in FIG. 1) of the printing substance depositer 101. The position of the longitudinal cutter 121 may be adjusted by the controller 150 in response to a detected position of the media 110, for example, the longitudinal cutter 121 may be repositioned as the media 110 advances to correct for a misalignment, such as described above.

The example printer 100 may therefore provide for full-bleed printing having margins 113*a*, 113*b* which are specifiable by an input to the printer while avoiding cutting the media 110 after removal from the printer 100. Examples of the present disclosure may avoid additional time and labor costs associated with cutting or trimming media to an appropriate size after printing and may be able to provide full-bleed prints of a range of widths. Examples described herein may provide a simple workflow for a user of an example printer and may produce a full-bleed print job in a single printer, with no subsequent cutting operation. Examples described herein may also use a low amount of oversprayed printing substance due to at least one lateral edge of the print output being produced by cutting, rather than overspraying. In examples, the printer can accurately cut along a desired path, for example along an edge of a printed area, to achieve a full-bleed edge. The printer may receive data specifying the location of edges of an area to be printed, i.e. co-ordinates of the margins, such as X co-ordinates of the lateral margins and/or Y co-ordinates of the leading edge 112 and trailing edge 114, or the width of desired full-bleed print job. In other examples, an example printer may detect margins of a print area 111 and may achieve accurate cutting to produce a full-bleed output, for example without the use of fiducial marks. Furthermore, the print media may not be restricted to a limited width media path since the longitudinal cutter can be positioned appropriately for cutting the print media at any lateral position. As such, examples described herein may provide for a low likelihood of contact with print heads or the like by wrinkles in the print media.

FIG. 2 shows a schematic representation of another example printer 300. The printer 300 is for producing a full-bleed print output on print media 310 and comprises components described above with reference with FIG. 1, description of which will not be repeated here. The example printer 300 of FIG. 2 comprises a first longitudinal cutter module 321 and a second longitudinal cutter module 322. In examples, the first longitudinal cutter module 321 and the second longitudinal cutter module 322 are positioned downstream of the printing substance depositer 301, with respect to the direction of media advance 303. In this example, the controller 350 is to receive, as an input, a print job to be printed in a full-bleed print mode and position the first longitudinal cutter module 321 and second longitudinal cutter module 322 to cut the print media 310 to produce first and second full-bleed print edges 313*a*, 313*b*. In some examples, the input may include data indicating the X position of one or both of the lateral margins 311*a*, 311*b* of the print area 311. In some examples, the input may include a predetermined width and the X co-ordinates of the margins 311*a*, 311*b* may be determined by the printer 300, for example by the controller 350. For example, the controller 350 may determine X co-ordinates of the margins 311*a*, 311*b*, for example from a width determined from the input, by positioning the print area 311 centrally on the print media 310, or positioning the print area 311 centrally with reference to a range of movement of the longitudinal cutter modules 321, 322. Producing the full-bleed output may comprise the controller 350 determining the position at which longitudinal cuts need to be made to produce the requested full-bleed output. For example, where the value of the X co-ordinate increases from left to right in the examples of FIG. 1 and FIG. 3, the position for the respective cuts may be at the margins 311*a*, 311*b* of the print area 311. In some examples, the position of the respective cuts may be within a range of up to around 1 mm to 5 mm, for example up to around 1 mm or around 3 mm, outside the print area 311 for the first longitudinal cutter module 321 and may be within a range of up to around 1 mm to 5 mm, for example around up to around 1 mm or around 3 mm, outside the print area for the second longitudinal cutter module 322. That is, in some examples the X co-ordinate of the first longitudinal cutter module 321 for cutting the first full-bleed margin 313*a* may be the X co-ordinate of the first lateral margin 311*a* minus up to around 1 mm to 5 mm, for example up to around 1 mm, or around 3 mm, while the X position of the second longitudinal cutter module 322 for cutting the second full-bleed margin 313*b* may be the X co-ordinate of the second lateral margin 311*b* plus up to around 1 mm to 5 mm, for example up to around 1 mm, or around 3 mm. In examples where the position of the cuts is within a range, such as a range of up to 1 mm to 5 mm inside or outside of the print area 311, the print output may in some examples be referred to as a full-bleed print. In some examples, the controller 350 may position the longitudinal cutter modules 321, 322 to produce cuts at an X co-ordinate within a range of X co-ordinates which are within a predetermined percentage of the width of the print area 311 from the margins of the print area 311. In another example, the cuts may be made within a range of X co-ordinates which are within a predetermined percentage of the width of the media 310 from, for example, the margins of the print area 311. The predetermined percentage of the width of the print area 311 or media 310 may be, for example, around 0.1%. This predetermined percentage of the width of the print area 311 may be determined by a tolerance in the width of the print area 311 printed by the printer 300. A similar tolerance may apply at the leading edge 312 or trailing edge 314 of the print area 311. The print medium 310 has a first lateral edge 310*a* and a second lateral edge 310*b*, which are not co-located with the first lateral margin 311*a* and second lateral margin 311*b* of the print area 311, respectively. That is, the print area 311 in this example does not extend all of the way to the lateral edges 310*a*, 310*b* of the media 310 and the print area 311 is therefore narrower than the media 310. As such, to produce the full-bleed edges 313*a*, 313*b* the controller 350 moves the longitudinal cutter modules 321, 322 to longitudinally cut the media 310 at respective positions substantially at the first and second margins 311*a*, 311*b* or at lateral positions within the print area 311. For example, the controller 350 may position the longitudinal cutter modules 321, 322 to make cuts at X positions within the print area, for example within around up to 1 mm to 5 mm or within a predetermined percentage of the width of the print area 311 or within a predetermined percentage of the width of the media 310, of each margin 311*a*, 311*b* of the print area 311. In some examples, making each cut within the print area 311 at a predetermined distance from each margin 311*a*, 311*b* may ensure that the print area 311 extends to the edges of the media 310 after the cuts have been made.

The example printer 300 may, for example, be an ink jet printer, an LED printer, or an offset printer. In some examples, the printer 300 may receive media 310 from a roll. The media 310 may be paper, such as plain paper, bond paper, matte paper or glossy paper, or may be card, or a plastics material. In some examples, the media 310 may include cardboard, cardstock, latex, vinyl, or other media suitable for use in a printer. The media 310 may be suitable for receiving a print substance, such as an ink, which may be an aqueous or non-aqueous ink, or toner, or wax, or a printing substance such as a pre-printing fluid or post-printing fluid, such as a primer, a coater, or a varnish. The printer 100 and media 110 of FIG. 1 may similarly be suitable for printing and receiving any substance mentioned with reference to the example of FIG. 3. In examples, the printer 300 may receive media 310 from a stack or ream, or receive one individual piece of media at a time. In this example, the printer 300 may pick media 310, and drive media 310, or deliver media 310 through the printer 300 in a direction of media advance 303.

The example printer 300 may receive an input, from a user or other source, requesting a full-bleed print job be produced by the printer. The input may include the dimensions of the area to be printed, for example, the X co-ordinates of the lateral edges 311*a*, 311*b* of the print area. The printing substance depositer 301 in this example comprises a print head 302, and the controller 350 controls the print head 302 to print the print area 311. In examples, the print head 302 may move laterally over the print media 310 and the print media 310 may be advanced incrementally through the printer 300 to allow the print head 302 to print across the width of the print area 311. In such examples, the printer 300 may be described as a scanning printer. In some examples, the printing substance depositer 302 may comprise may than one print head. In examples, the controller 300 positions the first and second longitudinal cutters 321, 322 to cut the media 310 to a width such that a full-bleed print is produced. The lateral position of the cut for producing a full-bleed lateral edge may be substantially at the lateral edge of the print area 311, or within the print area 311 so that some of the print area 311 is removed from the medium 310 by the cut made. In such examples, the controller 350, may, for example, take into account that a portion of the print area 311 is to be cut away by the longitudinal cutters 321, 322 and may size or position the image appropriately. The portion/s of the media 310 removed by the longitudinal cutter/s is shown in FIGS. 1 and 2 by broken lines.

The controller 350 may also control the operation of the print substance depositer 301 and, for example, may control a mechanism for advancing the print media 310. The controller 350 may in examples also control other components of the printer 300, such as the supply of power to components of the printer 300, such as the printing substance depositer 301 and the longitudinal cutter modules 321, 322. The controller 350 may comprise circuitry, such as wiring or the like, electrically connecting the controller 350 to the first and second longitudinal cutters 321, 322. The controller 350 may comprise means for receiving user input, such as user input buttons, or a touch interface. In some examples, the controller 350 may interact with a receiver (not shown) or comprise a receiver for receiving a print job via a transmission, such as a wired or wireless transmission from a computing device (not shown). The printer 300 may, for example, comprise computer readable instructions readable by the controller 350 for receiving a full-bleed print job, processing the job, and controlling the components of the printer 300 as described herein to produce a full-bleed print output.

The first longitudinal cutter module 321 and the second longitudinal cutter module 322 may be mounted for lateral movement, for example on a rail, shaft or track extending laterally across the path of the media 310. The longitudinal cutting modules 321, 322 may be independently translated laterally on the rail, track or shaft to orient the cutting module 300 anywhere across the width of the media 310, in order to provide a longitudinal cut to media 310 at a desired X position. In the example of FIG. 2, the first longitudinal cutter module 321 and second longitudinal cutting module 322 are mounted on a shaft 308. The shaft 308 provides for moving of the cutter module in the direction perpendicular to the media advance direction 303, i.e. the X direction. The shaft 308 also, in some examples, provides drive for the first longitudinal cutter module 321 and second cutter module 322 to cut the media 310, and in such examples the shaft 308 may be referred to as a drive shaft, as will be described in more detail below. In examples, each of the first longitudinal cutter module 321 and second longitudinal cutter module 322 comprises a cutter for cutting media 310. Example cutters used in the first and second longitudinal cutter modules 321, 322 may have a sharp cutting edge, or knife edge with which the cutter may cut media. In some examples, the cutter may be round, or a rotary cutter, wherein the cutter is to cut media by rotating with media 310 moving past the cutting module 321, 322. In other examples, the cutter may have a straight cutting edge that may cut media when the media is moved against and past the straight cutting edge, in a similar fashion to a knife blade. In examples, the cutter may comprise at least one rotary blade. In other examples, the cutter may comprise a knife or box-cutter mounted to the cutter module. The cutter may comprise stainless steel. In examples each cutter module 321, 322 receives power and comprises means for supplying power to a powered cutter. In some examples, the controller may control a component or device, such as a translator (not shown in FIG. 2), to move the longitudinal cutting module 321 along the drive shaft 308. Examples of such a translator will be discussed in more detail below.

In examples, the position of the leading margin 312 and trailing margin 314 of the print area 311 may be specified by the input or otherwise accessed or determined by the controller 350. To produce the full-bleed print job, the controller 350 may ensure that full-bleed print edges are produced at the leading edge 312 and the trailing edge of the media 310. As described above, with reference to FIG. 1, a full-bleed edge at the leading edge 312 may be produced by the printing substance depositer 301 overspraying at the leading edge 312. In this example, the printer 300 comprises a lateral cutter module 330 for cutting the media 310 in the X direction. The controller 350 may receive in the input of the full-bleed print job, or may be able to determine from the input, the Y co-ordinates of the leading edge 312 and trailing edge of the full-bleed print job. In examples, the controller 350 controls the lateral cutter module 330 to laterally cut the media 310 at the trailing edge of the print output. The lateral cut may be at a trailing edge of the print area 311, or may be downstream of the trailing edge of the print area 311 to produce a full-bleed edge. In examples, the advance of the media 310 is paused at such a position that the lateral cutter module 330 can laterally cut the media 310. The lateral cutter module 330 may comprise a cutter disposed on a rail extending laterally across the path or media 310 and the cutter may, for example, comprise a rotary cutter. In other examples, any other suitable cutting mechanism for laterally cutting the media 310 may be used, such as a guillotine.

In some examples, the controller 350 may position the longitudinal cutter modules 321, 322 to account for a position or orientation of the media 310 in the printer 300. For example, the controller 350 may position the longitudinal cutter modules 321, 322 to account for a lateral position of the lateral edges 310*a*, 310*b* of the media 310. In some examples, the media 310 may become displaced in the X direction or the lateral edges 310*a*, 310*b* may become misaligned with the media advance direction 303. For example, the lateral edges 310*a*, 310*b* may become out of line with the print media advance direction 303 as the media 310 advances. This misalignment may be due to initial misalignment of the media 310 or may be due to telescoping error in a roll of media 310, as described above. In such examples, the lateral edges 310*a*, 310*b* of the media 310 may progressively become displaced in the X direction, but may in some examples reach a stable, displaced position in the X direction. In some examples, the first margin 311*a* or the second margin 311*b* may not be aligned with the first lateral edge 310*a* and second lateral edge 310*b* of the print medium 310. The controller 350 may, for example, change the position of the longitudinal cutter module 321 as the media 310 advances, to follow a print margin 311*a* which is not linear, or which is not aligned with the lateral edges 310*a*, 310*b*. The printer 300 may, therefore, in some examples correct for a skew in the print area 311, for example due to the print media 310 becoming misaligned with the Y direction. The printer 300 may, for example, comprise detection means (e.g., 152 of FIG. 1; 352 of FIG. 3), such as optical detection means, for determining when the longitudinal cutters 321, 322 should be repositioned along the X direction. For example, the detection means may detect the margins 311*a*, 311*b* of the print area 311. That is, in some examples, the printer 300 may detect the location of margins 311*a*, 311*b* of the print area 311 and based on these detected locations, position the first and second longitudinal cutter modules 321, 322 to cut the media 310 at a position to produce a full-bleed output. In other examples, the printer 300 may detect the position of the lateral edges 310*a*, 310*b* of the media 310, and may position the longitudinal cutter modules 321, 322 taking into account any misalignment of the lateral edges 310*a*, 310*b* with the media advance direction 303. The controller 150 of printer 100, described with reference to FIG. 1, may also correct for misalignment of the print media 110, and may comprise any of the features described here for printer 300.

Figure 3A:
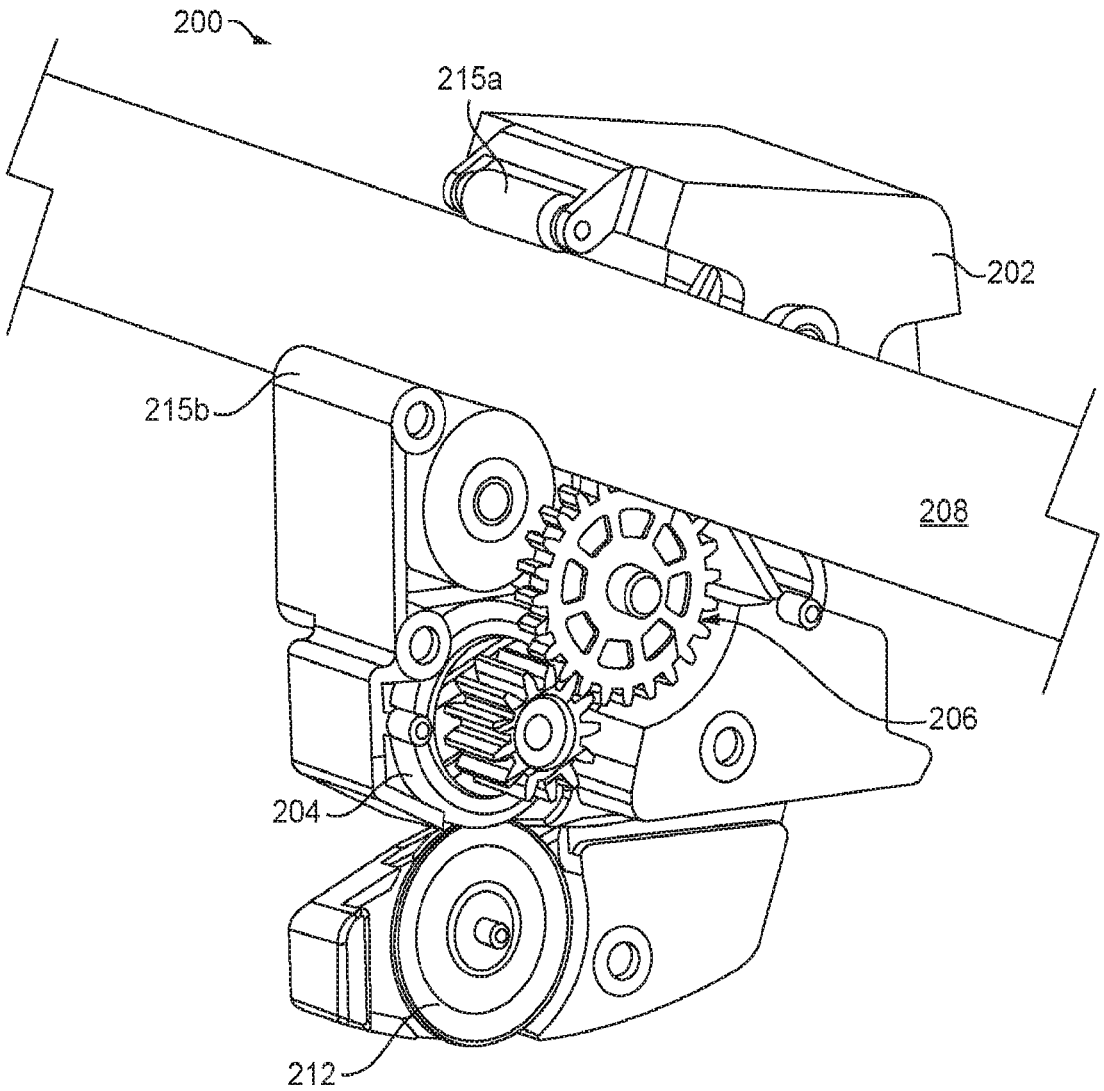
FIGS. 3A-3C show illustrations of an example cutter module.
Figure 3B:
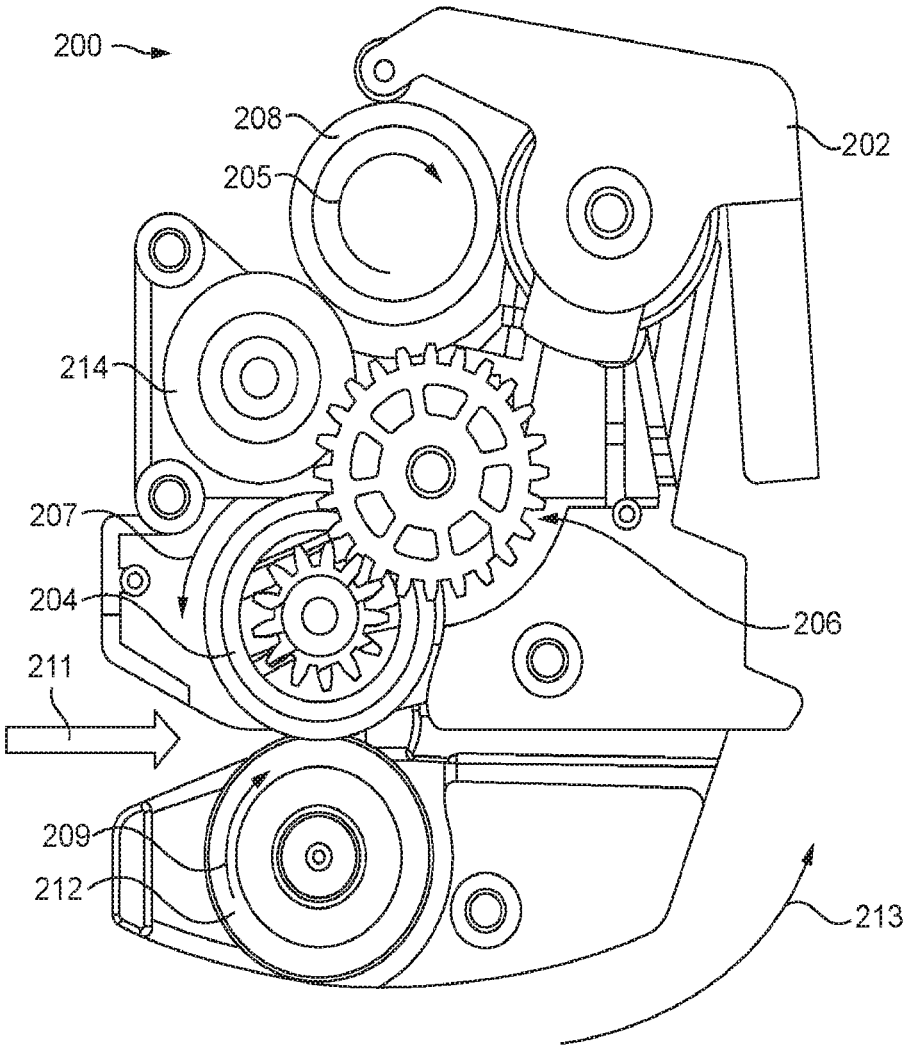

Referring now to FIGS. 3A-B, a partially cross-sectional perspective view and a side view, respectively, of an example longitudinal cutting module 200, such as may be used in the example printers of FIG. 1 or FIG. 2, is illustrated. The example cutting module 200 may be engaged with a drive shaft 208. Drive shaft 208 may be operably engaged with a motor, transmission, or other drive mechanism to rotate the drive shaft in a first direction 205. The drive shaft 208 may be engaged with a housing 202 of the cutting module 200 such that the drive shaft 208 supports the cutting module 200. The housing 202 may include a roller or rollers 215*a*, 215*b* such that the drive shaft 208 may rotate relative to the cutting module 200. In some examples, the drive shaft 208 may engage with the cutting module 200 through three rotatable points of contact, such that the drive shaft 208 can fully support the cutting module 200, and still rotate relative to the cutting module 200. Further, the cutting module 200 may include a drive system 206 to drive a cutter 204 to cut media travelling through a media path 211 in a direction of media advance. The drive system 206 may engage with the drive shaft 208 such that the rotation of the drive shaft 208 is transmitted to rotation of the cutter 204. More specifically, for example, rotation of the drive shaft 208 in the first direction 205 may be transmitted through a friction wheel 214, which may be a rubber wheel, which may then transmit the rotation through a transmission, or, through a series of cogs, gears, friction wheels, or other suitable components to drive or rotate the cutter in cutting direction 207, as illustrated in FIG. 3B. In some implementations, cutting direction 207 may be the same direction as the media path 211, such that, as media is delivered along the media path 211, the cutter 204 is rotated in the same direction as the media is moving so as to cut the media. Additionally, in some examples, drive system 206 may include suitable gear ratios or gear sizes such that the rotation of the drive shaft 208 results in the cutter 204 rotating at a suitable or adequate angular velocity so as to cut the media as it travels along the media path 211.

Further, cutting module 200 may further include a second cutter 212 to cut media travelling through the media path 211 in a direction along the media advance direction, for example as described with reference to FIG. 2. In such an example, the cutter 204 may then be a first cutter 204. In some examples, the second cutter 212 may be similar to the first cutter 204. In further examples, the first and second cutters 204 and 212 may both be rotary cutters. In some examples, the first cutter 204 and the second cutter 212 may be oriented relative to one another so as to adequately cut media along the media advance direction 211 when the media is delivered in between the first and second cutters 204 and 212. In some examples, the first and second cutters 204 and 212 may each have a cutting edge that overlaps with the cutting edge of the other cutter. Additionally, the second cutter 212, in some examples, may also be driven by the drive system 206 to cut media. In other examples, the second cutter 212 may be driven along direction 209, in the same direction as the media path 211, through contact with the media travelling along the media advance direction 211.

Figure 3C:
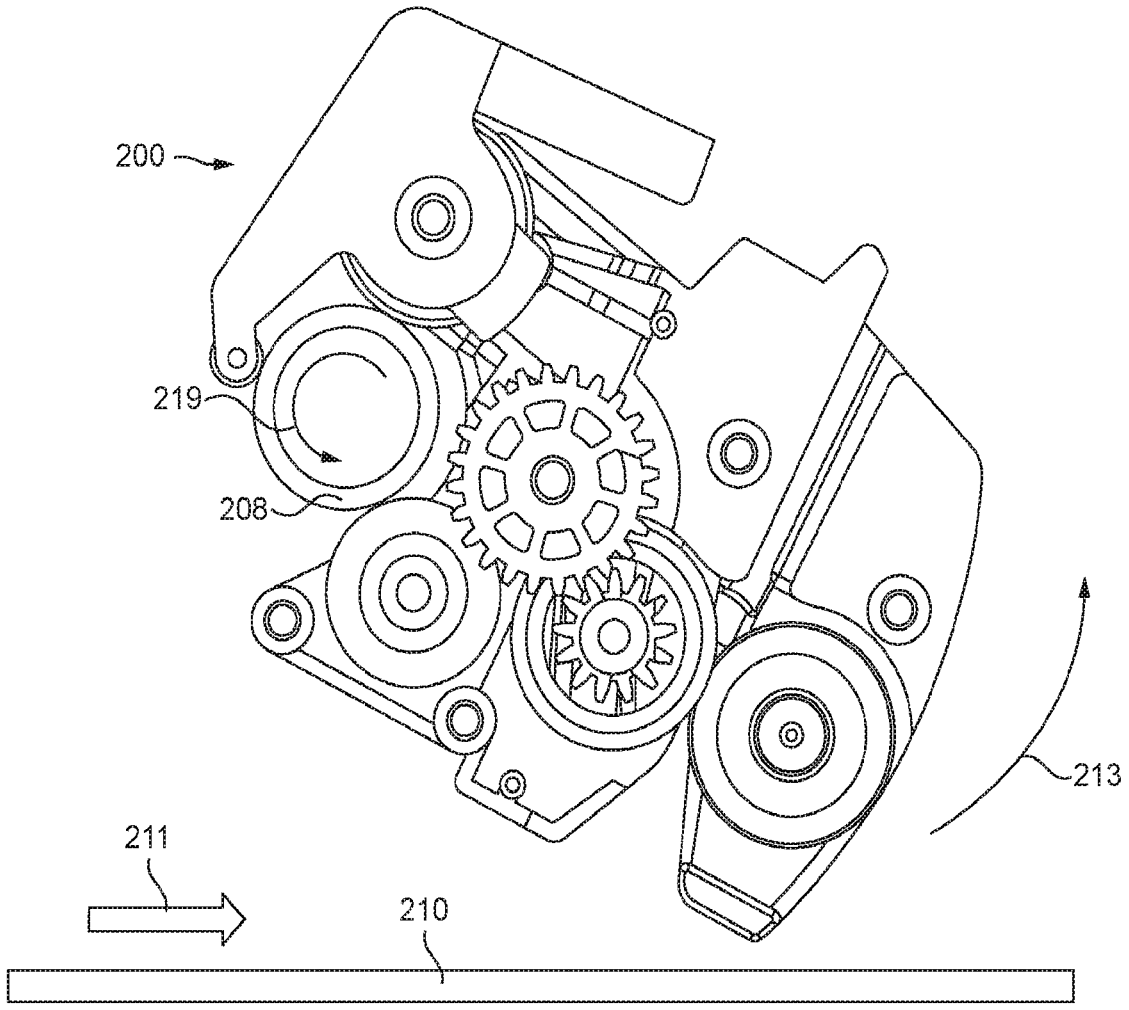

Referring additionally to FIG. 3C, a side view of an example cutting module 200 is illustrated. In some examples, it may be desirable to output the media from the printer without cutting or trimming the media along the media advance direction 211. For example, the cutting module 200 may be adjusted, moved, or rotated out of the path of the media 210. The cutting module 200 may be stowed such that the cutting module 200 does not cut or trim media 210 travelling through the media path 211, as illustrated in FIG. 3C. In some examples, the cutting module 200 may be stowed by rotating about a longitudinal axis of the drive shaft 208 until the cutter 204 and/or the second cutter 212 is removed from the path of the media, and the cutting module no longer cuts media therein. In further examples, the drive shaft 208 may rotate the cutting module 200 about the longitudinal axis of the drive shaft 208 out of the media path 211. In yet further examples, the drive shaft 208 may rotate in a second direction opposite that of direction 205, such as direction 219, for example, in order to rotate the cutting module 200 out of the media path, for example, along direction 213. In still yet further examples, the drive system 206 may lock when the drive shaft 208 rotates in the second direction 219, such that the rotation of the drive shaft 208 causes the housing 202 to rotate along example direction 213 until the cutter 204 is no longer disposed in the media path 211 and the cutting module 200 no longer cuts media within the media path 211.

Figure 4A:
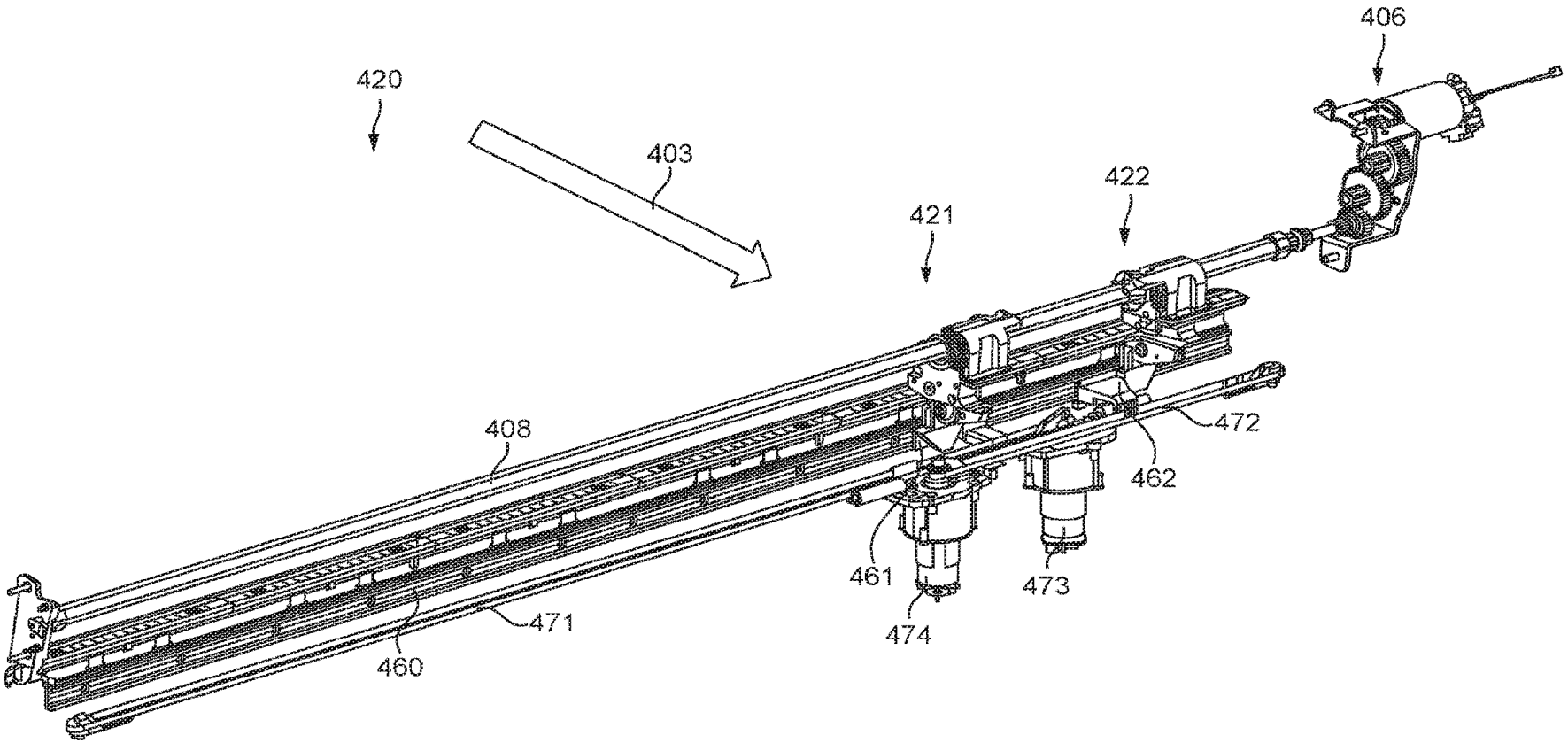
FIG. 4A shows a perspective view of an example cutting section of an example printer with longitudinal cutters in a first configuration.
Figure 4B:
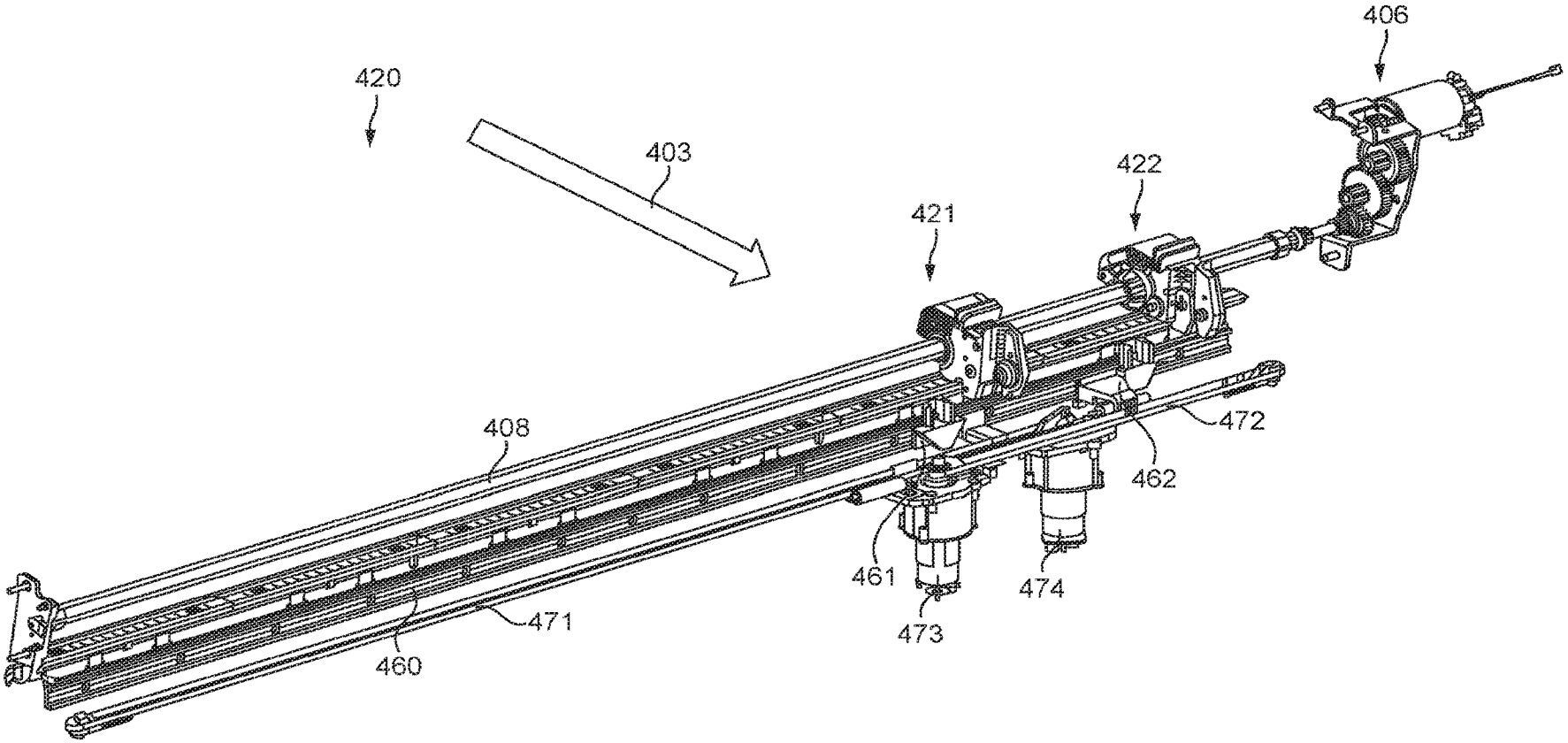
FIG. 4B shows the example cutting section of FIG. 4A with the longitudinal cutters in a second configuration.

Referring now to FIGS. 4A and 4B a perspective view of an example longitudinal cutting section 420 of a printer is illustrated. The remainder of the printer is not shown in this illustration. The example longitudinal cutting section 420 includes a first longitudinal cutter module 421 and a second longitudinal cutter module 422. The first and second cutter modules 421, 422 are engaged with a support shaft 408, or, in some examples, a drive shaft 408. In FIG. 4A the first and second longitudinal cutter modules 421, 422 are shown in first configuration wherein the cutter modules 421, 422 are lowered and in an engaged configuration to cut media (not shown in FIGS. 4A and 4B) advancing along a media advance direction 403, corresponding to the position of cutter 200 shown in FIG. 3B. In FIG. 4B the first and second longitudinal cutter modules 421, 422 are shown in second configuration wherein the cutter modules 421, 422 are raised and in configuration wherein the cutters are not engaged to cut media advancing along a media advance direction 403, corresponding to the configuration of cutter 200 shown in FIG. 3C. The first longitudinal cutter module 421 and second longitudinal cutter module 422 may comprise any of the features described above with reference to FIGS. 1, 2 and 3A-C.

In examples, the first longitudinal cutting module 421 may be controlled by a controller, such as any example controller described with reference to FIGS. 1 to 3A-C, to move along a longitudinal axis of the drive shaft 408, in a direction perpendicular to the media advance direction 403, to be positioned for cutting media advancing along media advance direction 403. The cutting section 420 comprises a first translator, or a first carriage 461, to engage with the first longitudinal cutter module 421 to position the cutter module along the shaft 408. In this example, the carriage 461 is controlled by a drive system such as a first belt system comprising a first belt 471 and a first drive unit 473. The first drive unit 473 may be controlled by the controller to move the first belt 471 and move the first carriage 461, engaged with the first belt 471, along the X direction and thereby position the first cutting module 421. In some examples, one carriage may be used to position both cutter modules 421, 422. In some examples, such as that shown in FIGS. 4A and 4B, the cutting section 420 comprises a second translator, or second carriage 462. In this example, the second carriage 461 is controlled by a drive system such as a second belt system comprising a second belt 472 and a second drive unit 474. The second drive unit 474 may be controlled by the controller to move the second belt 472 and move the second carriage 462, engaged with the second belt 472, along the X direction and thereby position the second cutting module 422. The first drive unit 473 and/or second drive unit 474 may, for example, be a motor, such as an electric motor and may be controlled by the controller of the printer. In examples, the first carriage 461 is for engaging with and moving the first longitudinal cutter module 421 and the second carriage 462 is for engaging with and moving the second longitudinal cutter module 422. The first carriage 461 and the second carriage 462 may be mounted on a rail or track 460 such that they may be positioned along the X direction by drive belts 471, 472. In some examples, the first and second carriages 461, 462 may be driven by the same drive system, such as by the same drive belt.

In FIGS. 4A and 4B, each of the first belt system, comprising first belt 471 and first drive unit 473, and second belt system, comprising second belt 472 and second drive unit 474, is a pulley drive. In other examples, the drive system for each of the first and second longitudinal cutters 421, 422 may comprise a chain or other type of drive capable of moving each carriage 461, 462 and cutting module 421, 422 along the X-direction. In some examples, the cutting section 420 may include another component, such as a worm gear, or other transmission components to move the carriages 461, 462, and thus the cutting modules 421, 422 along the X-direction. The first carriage 461 may be capable of supporting and/or adjustably fixing the first cutting module 421 in position along the drive shaft 408 after the first carriage 461 has moved the cutting module 421 along the drive shaft 408 to a desired position, for example to make a cut to the media to produce a full-bleed print. Similarly, the second carriage 462 may be capable of supporting and/or adjustably fixing the second cutting module 422 in position along the drive shaft 408 after the second carriage 462 has moved the cutting module 422 along the drive shaft 408 to a desired position.

In further examples the first and second longitudinal cutter modules 421, 422 may be removably coupled to the first carriage 461 and second carriage 462 respectively. In some examples, as described with reference to FIGS. 3A-C, the drive shaft 408 may rotate in a direction to move the cutter module/s from a first configuration shown in FIG. 4A wherein the cutters are in the path of the media, to a second configuration shown in FIG. 4B wherein the cutters are out of the path of the media such that the cutting modules 421, 422 do not cut media. In such examples, the first and second cutting modules 421, 422 may be removable from engagement with the first and second carriages 461, 462 respectively so that the cutting module 421, 422 may rotate out of the path of the media and avoid cutting media. In the example shown in FIGS. 4A and 4B, in changing from the first configuration to the second configuration, the cutter modules are rotated out of the media path by rotating in a direction such that the cutters move backwards, along the media advance direction 403, in a movement corresponding to the rotational arrow 213 showing rotation of the cutter 200 of FIG. 3C. Each cutting module 421, 422 may be engageable or re-engageable with each carriage 461, 462 if the drive shaft 408 rotates the cutting module 421, 422 back into the path of the media.

In examples, the cutting section 420 comprises a drive system 406 capable of driving the drive shaft 408 which transmits rotational motion to the cutters 421, 422 to allow the cutters to cut media. The drive system 406 may include drive wheels, cogs, teeth, pulleys, belts, or other suitable mechanical or electro-mechanical components. In examples, the drive system may comprise a motor, or may be engaged with a motor, or another electrical component capable of rotating the drive shaft 408. In the example of FIG. 4, the drive shaft 408 is coupled to a drive system 406 which may include a drive motor (not shown) coupled to a drive gear train (not shown), including a number of gears, for transmitting rotation of the drive motor to the shaft 408. For example, the drive motor may be a BLDC motor or a stepping motor or another electric motor. The drive motor may be supplied and driven via supply/drive lines operatively coupled to the controller (not shown in FIG. 4) of the printer, for example. In some examples, the drive shaft 408 has a polygonal cross-section, such as a hexagonal cross-section. In other examples, the drive shaft 408 may have a circular or noncircular, elliptic or a non-symmetrically shaped cross-section.

Figure 5:
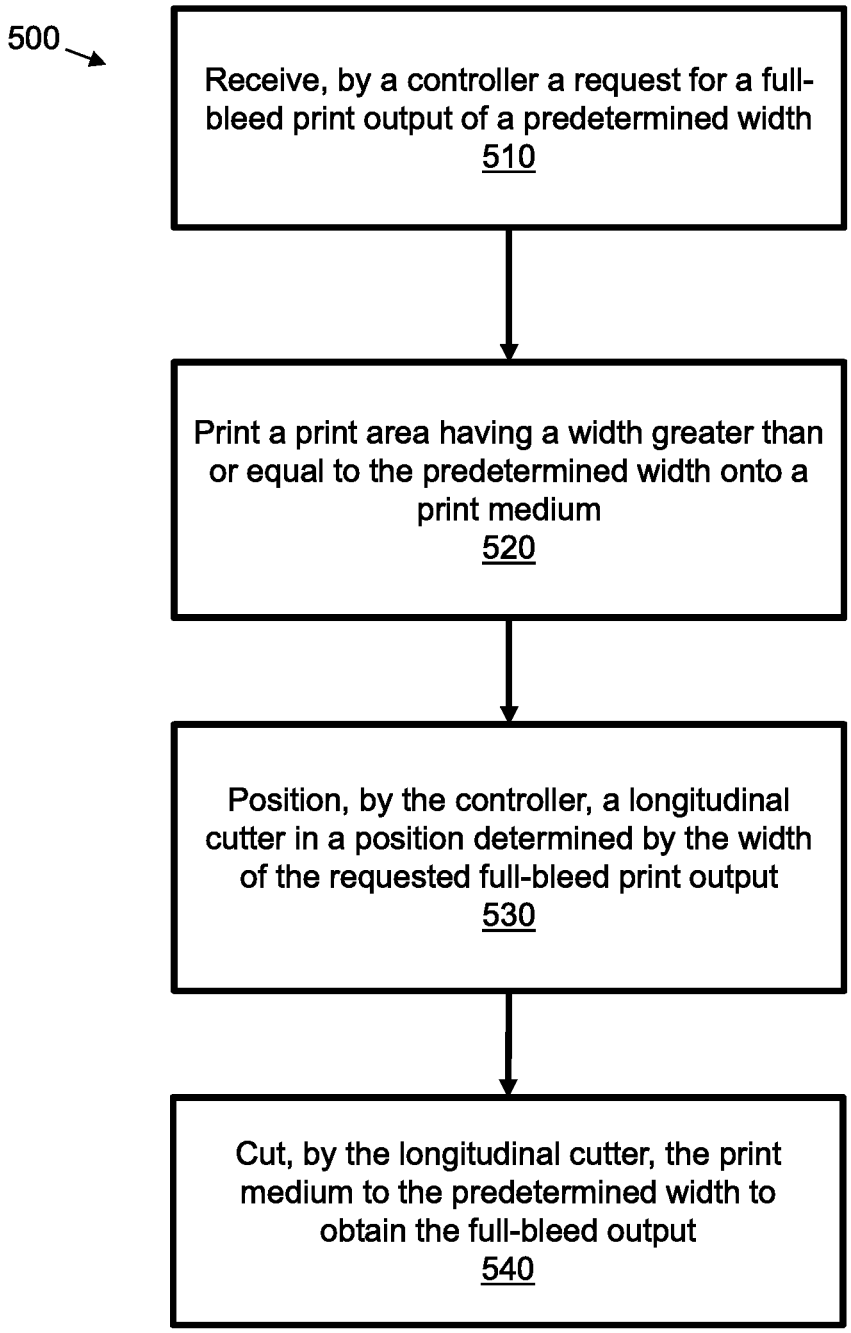
FIG. 5 shows a flow chart representation of an example method.

FIG. 5 shows a flowchart representation of an example method according to this disclosure. The example method comprises, at block 510, receiving by a controller in a printer, a request for a full-bleed print output having a predetermined width. The request may specify data indicating the position of at least one of the margins of the print output. In some examples, the request may specify a predetermined width for the print output or may specify data allowing the predetermined width to be determined by the printer. In some examples, the request may specify one or more X co-ordinates corresponding to one or more margins of the full-bleed print output. In some examples, the controller may receive an input indicating a requested width and may determine the X co-ordinates of the margins from the predetermined width, for example by positioning the print area centrally on the print media, or otherwise determining X co-ordinates for positioning the print area on the media. The printer may be an example printer as described with reference to any of FIGS. 1 to 4, for example a printer 100 according to FIG. 1. The request for a full-bleed print output may specify a size of the print output to be produced, for example specifying the X co-ordinates of the lateral margins of the print area, as described above. The method also comprises, at block 520 printing a print area onto the media wherein the print area is wider than, or has a width equal to, the predetermined width of the full-bleed print output. The method also comprises, at block 530, positioning, by the controller, of a longitudinal cutter module of the printer, in a position which is determined by the width of the requested full-bleed print output. For example, block 530 may comprise positioning the longitudinal cutter module at a position determined by a lateral margin of the print area, for example at a position at the lateral margin of the print area or at a position aligned with the lateral margin of the print area, but inside of the print area. The method comprises, at block 540, cutting, by the longitudinal cutter module, of the print medium to the predetermined width to obtain a full-bleed print. For example, the method may comprise at block 540 cutting the media longitudinally along the media at positions determined based on the lateral margins of the print area, as described above. The longitudinal cutter may cut the media as the media advances in the media advance direction. In some examples, the printer may print a print area extending to a second lateral edge of the print medium such that a first longitudinal cutter module cuts a first margin but there is no cutting at the second margin. To produce a full-bleed print, extending to both lateral edges then involves cutting by the longitudinal cutter module along the first lateral margin of the print area, or cutting the media at a lateral position inside the print area towards the first lateral margin.

Figure 6:
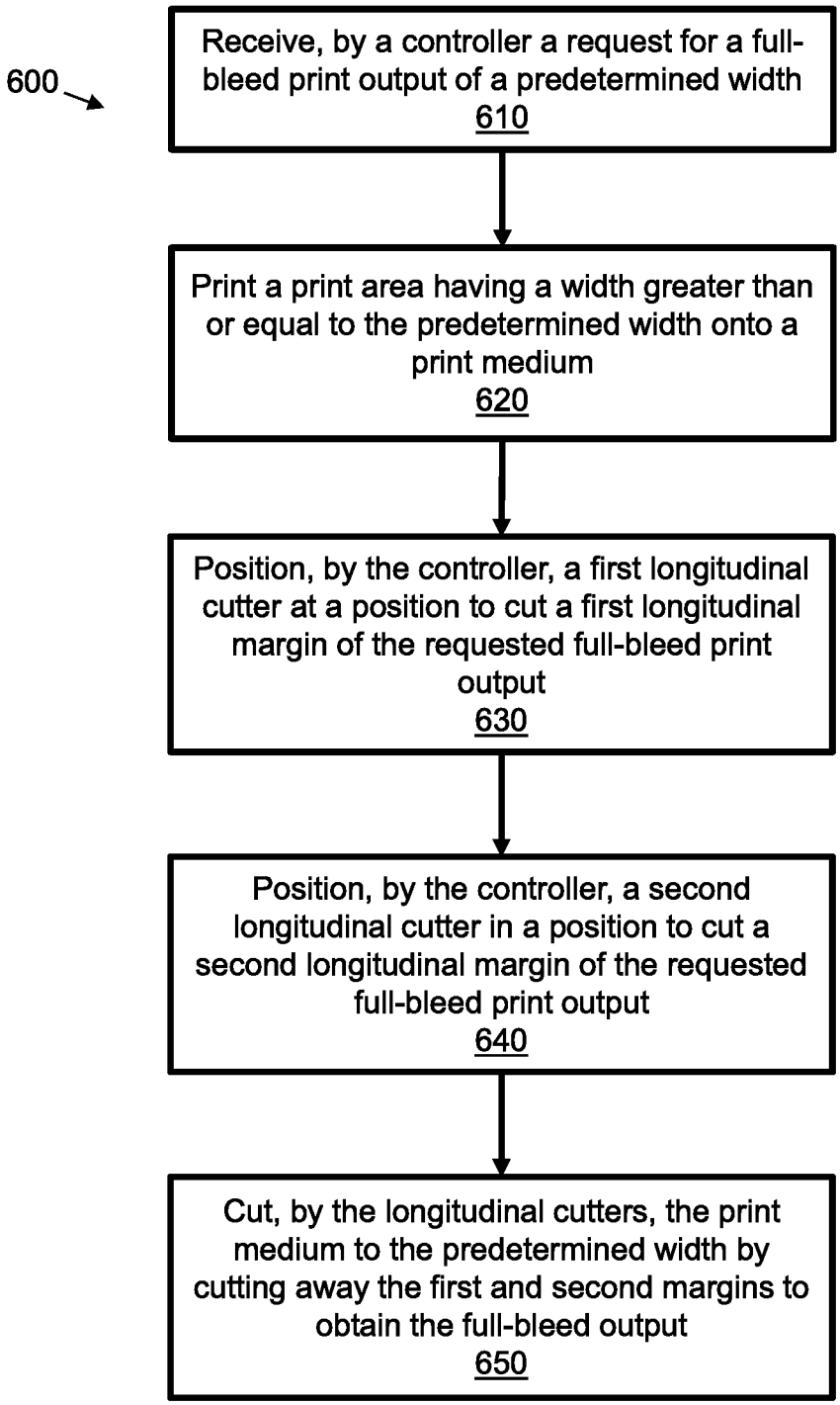
FIG. 6 shows a flow chart representation of another example method.

FIG. 6 shows a flowchart representation of a second example method. The example method of FIG. 6 may be performed by, for example, a printer having a first and a second longitudinal cutter module, such as the example printer 300 described according to FIG. 2. The method of FIG. 6 may comprise any of the features described with reference to FIGS. 1 to 4. The method comprises, at block 610, receiving by a controller a request for a full-bleed print output of a predetermined width, the request may, for example, comprise data indicating the X co-ordinates of the margins of the print output. As described above, the input may, in some examples, specify a width and the controller of the printer may determine the positions of the margins to be cut based on this predetermined width. At block 620, the method comprises printing a print area onto a print medium wherein the print area has a width greater than or equal to the predetermined width of the full-bleed print output. At block 630, the method comprises positioning, by the controller, a first longitudinal cutter at a position to cut a first longitudinal margin of the requested full-bleed print output. The method may comprise the controller determining the position at which longitudinal cuts need to be made to produce the requested full-bleed output. In examples, the method comprises the request specifying a predetermined width of the requested full-bleed print output and the controller may be to determine, from the predetermined width, at least one co-ordinate defining a margin of the full-bleed print output. For example, the position for the respective cuts may be around 3 mm outside the print area for the first longitudinal cutter module 321 and may be around 3 mm outside the print area for the second longitudinal cutter module 322. The method may also comprise detecting a margin of the print area, or detecting a first margin and a second margin of the print area, and in response to the detected margin/s of the print area, determining a position for the longitudinal cutter module/s.

The method also comprises, at block 640, positioning, by the controller, a second longitudinal cutter at a position to cut a second longitudinal margin of the requested full-bleed print output. For example, the first longitudinal cutter may be mounted on a shaft and positioned by a carriage as described with reference to FIG. 4. The method may comprise positioning the longitudinal cutter by the controller to cut the media at a position determined based on a coordinate determined according to an example at block 630. The longitudinal cutter module/s may be positioned by the controller according to any of the above examples, for example, by use of one or more carriages. In examples, the controller may reposition one of the longitudinal cutter modules of both of the longitudinal cutter modules as the print media advances. This repositioning may be based on a detected margin of the print area. For example, the controller may detect, as described above, that a margin or margins of the print area are not aligned with the media advance direction. The controller may then reposition the longitudinal cutter module or cutter modules along the direction perpendicular to the media advance direction as the media advances along the media advance direction to ensure that a full-bleed output is produced.

The method further comprises, at block 650, cutting, with the first and second longitudinal cutter modules, first and second margins of the full-bleed print output. Cutting of the first and second margins produces a full-bleed print output having printing substance deposited to both of the lateral margins. That is, as described above, the first longitudinal cutter module cuts away a first strip of the media to produce a first full-bleed edge, and the second longitudinal cutter module cuts away a second strip of the media to produce a second full-bleed edge. As also described above, a full-bleed print with printing substance extending to all margins may be produced in examples by use of a lateral cutting module, for example to cut the media at a trailing edge. The method may also comprise overspraying at a leading edge of the medium in order that the printing substance extends all of the way to the leading edge.

Although examples described hereinabove have described full-bleed print jobs having one print area, in some examples an example print job may comprise a plurality of print areas. For example, an example printer may produce a print job comprising a plurality of print areas on media, and each print area may have a first lateral margin and a second lateral margin. Each print area may be to produce a full-bleed print output, therefore a full-bleed print job may comprise a request for a plurality of full-bleed print outputs. In some examples, the first lateral margin and second lateral margin of adjacent print areas may be separated in the X direction. In examples, the printer may comprise a first longitudinal cutter module and a second longitudinal cutter module for cutting each print area. Each first longitudinal cutter module and a second longitudinal cutter module may have the features of any of the examples described herein and may be positioned by the controller as described in any of the examples herein. The controller may position each pair of longitudinal cutter modules and control each pair of longitudinal cutter modules to make longitudinal cuts, for example along the margins of each print area, as described with reference to examples herein. In other examples, an example printer may comprise at least one longitudinal cutter module for each print area. For example, a first margin of one print area and a second margin of a second print area may be adjacent and not separated in the X direction, and, as such, one longitudinal cutter module may make a single longitudinal cut along the two adjacent print area margins. In some examples, the printer may comprise at least one longitudinal cutter module for each print area, for example where overspraying is used at one lateral edge of the print media and therefore at one margin of one of the print areas. In some examples, a printer may comprise more than one longitudinal cutter module for each print area but the controller may engage and control a number of longitudinal cutter modules equal to the desired number of longitudinal cuts to be made to produce the print job. In some examples, where the print job comprises a number n of print areas, and comprises margins between print areas which are not separated in the X direction, the printer may comprise a number 2n+1 of longitudinal cutter modules, or the controller may position and engage a number 2n+1 cutter modules to make 2n+1 cuts to produce the print job.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A printer comprising:

at least one longitudinal cutter module to cut a print medium in a longitudinal direction with respect to a print media advance direction; and a controller to position the cutter module along a direction perpendicular to the print media advance direction; wherein the controller is to receive a full-bleed print job and, as the received print job is printed on the print medium to realize a print area on which the print medium has been printed, position the at least one cutter module along the direction perpendicular to the print media advance direction based on at least one detected corresponding margin of the print area to longitudinally cut the print medium to produce full-bleed output corresponding to the received print job.

2. The printer according to claim 1, wherein the at least one cutter comprises a first longitudinal cutter module and a second longitudinal cutter module, the at least one detected corresponding margin comprises a first margin corresponding to the first longitudinal cutter module and a second margin corresponding to the second longitudinal cutter module, and the controller is to position the first cutter module and the second cutter module along the direction perpendicular to the print media advance direction based on the first margin and the second margin, respectively, of the print area.

3. The printer according to claim 2, further comprising a first carriage and a second carriage, wherein the first carriage is to position the first longitudinal cutter module and the second carriage is to position the second longitudinal cutter module.

4. The printer according to claim 2, wherein the printer is to detect the first margin and the second margin as the print medium advances along the print media advance direction, such that the first margin and the second margin of the print area are non-linear.

5. The printer according to claim 1, wherein the longitudinal cutter module is mounted on a shaft to move along the direction perpendicular to the print media advance direction and wherein the longitudinal cutter module is positioned along the shaft by a first carriage mounted on a track or rail.

6. The printer according to claim 1, further comprising a lateral cutter module to laterally cut the print medium at an upstream end of the print job with respect to the print media advance direction.

7. The printer according to claim 1, wherein the at least one cutter module is rotatable between a cutting position in which the at least one cutter module cuts the print medium as the print medium is advanced along the print media advance direction and a non-cutting position in which the at least one cutter module does not cut the print medium as the print medium is advanced along the print media advance direction.

8. A method comprising:

receiving, by a controller in a printer, a request for a full-bleed print output of a print job;

printing, by the printer, the print job onto a print medium to realize a print area on which the print medium has been printed;

detecting, by the printer, at least one margin of the print area, as the print job is printed onto the print medium;

positioning, by the controller, at least one longitudinal cutter module in the printer along a direction perpendicular to a print media advance direction based on the detected at least one margin of the print area; and cutting, by the longitudinal cutter module, the print medium to produce the full-bleed print output of the print job.

9. The method according to claim 8, wherein the at least one longitudinal cutter module comprises first and second longitudinal cutter modules, the at least one margin comprises first and second margins, and positioning the at least one longitudinal cutter module comprises moving the first and second longitudinal cutter modules to first and second lateral positions respectively based on the detected first and second margins.

10. The method according to claim 8, wherein the at least one margin of the print area is detected as the print medium advances along the print media advance direction, such that the at least one margin is non-linear.

11. The method according to claim 8, further comprising:

rotating the at least one cutter module from a non-cutting position in which the at least one cutter module does not cut the print medium as the print medium is advanced along the print media advance direction to a cutting position in which the at least one cutter module cuts the print medium as the print medium is advanced along the print media advance direction.

* * * * *